US006598453B2

(12) United States Patent
Murai et al.

(10) Patent No.: US 6,598,453 B2
(45) Date of Patent: Jul. 29, 2003

(54) TOOTH ROLLING FLAT DIES AND METHOD FOR FORMING TEETH

(75) Inventors: Yasuhiro Murai, Toyama (JP); Takahiro Kumagai, Toyama (JP); Soiti Kakutani, Toyama-ken (JP); Masaru Sumitani, Toyama (JP)

(73) Assignee: Nachi-Fujikoshi Corp., Toyama (JP)

( * ) Notice: Subject to any disclaimer, the term of this patent is extended or adjusted under 35 U.S.C. 154(b) by 0 days.

(21) Appl. No.: 09/971,043

(22) Filed: Oct. 5, 2001

(65) Prior Publication Data

US 2002/0043094 A1 Apr. 18, 2002

(30) Foreign Application Priority Data

Oct. 13, 2000 (JP) ..... 2000-312994

(51) Int. Cl.[7] ..... B21H 5/04
(52) U.S. Cl. ..... 72/469; 72/88
(58) Field of Search ..... 72/88, 90, 469; 76/107.1

(56) References Cited

U.S. PATENT DOCUMENTS 1,961,257 A * 6/1934 Thomson ..... 72/469
2,967,756 A * 1/1961 Mazzucchelli ..... 428/539.5
3,536,602 A * 10/1970 Jones ..... 204/164
3,650,930 A * 3/1972 Jones ..... 204/177
3,889,516 A * 6/1975 Yankee et al. ..... 72/469
4,563,890 A * 1/1986 Dickson ..... 72/469
4,793,219 A * 12/1988 Wozniak ..... 76/107.1
4,862,718 A 9/1989 LaCroix ..... 72/469

FOREIGN PATENT DOCUMENTS

JP 6-200 1/1994

* cited by examiner

*Primary Examiner*—Daniel C. Crane
(74) *Attorney, Agent, or Firm*—Venable; Norman N. Kunitz

(57) ABSTRACT

A tooth rolling flat die and a method for forming a tooth are provided. The die has the same service life as those of the conventional tooth rolling flat dies using oil coolant even if conducted by semi-dry forming. A first substantially quarter length portion of the leading teeth section of the die has a first surface roughness Rz of maximum height ranging from 20 to 35 μm, and a second substantially quarter length portion of the leading teeth section of the die has a second surface roughness Rz of maximum height ranging from 5 to 20 μm. The die is adapted for semi-dry forming the tooth.

10 Claims, 2 Drawing Sheets

TOOTH ROLLING FLAT DIES AND METHOD FOR FORMING TEETH

BACKGROUND OF THE INVENTION

1. Field of the Invention

The present invention relates generally to tooth rolling flat dies for forming teeth, such as spline teeth and gear teeth on the periphery of cylindrical workpieces, and in particular to tooth rolling flat dies and a method for forming the teeth which are adapted for forming the teeth by semi-dry forming in which a very small amount of oil mist is sprayed on the workpieces to be rolled.

2. Description of the Related Art

Tooth rolling flat dies are known means for forming teeth, such as spline teeth and gear teeth on the periphery of cylindrical workpieces, and are generally rectangular plate members having one working surface thereon toothed. These teeth include alternate ridges and grooves, which conform in plan to the shape of the teeth to be rolled. The teeth run the length of the die face. The dies are used in mating pair with their toothed working faces facing each other. A cylindrical workpiece of the teeth to be rolled is placed between the dies at one end thereof. The dies are then pressed against the cylindrical workpiece and the dies is moved longitudinally, thereby rotating the workpiece about its axis and roll forming the teeth thereon while the workpiece is at ambient or room temperature and without removal of material from the workpiece.

Conventional tooth rolling flat dies are shown, for example, in U.S. Pat. No. 4,862,718 in which each of the working face having a start, which is a chamfer with depth equivalent to thread depth, and a ramp region on the die to permit the die to penetrate the cylindrical blank at a controlled rate until full depth is reached. These dies have also a dwell portion or finishing portion having full ridge height and a roll-off section which permit gradual loss of contact between the die and workpiece, without marking the finished workpiece.

Also, in Japanese examined utility model publication Hei 6(1994)-200 discloses in its FIG. 4 which is reproduced in FIG. 3 PRIOR ART of present application. Each die face of the tooth rolling flat dies 11(12) shown in the FIG. 3 is provided thereon in series a leading teeth section 13 wherein height of the tops of the teeth 7 are gradually increasing from the front edge C to the rear edge D of the die until full height 3*f* thereof is reached to permit the die to penetrate the cylindrical workpiece until full depth is reached, a finishing teeth section 14 in which each of the teeth having full ridge height and a roll-off teeth section 15 in which height of the tops of the teeth are rapidly decreasing to permit gradual loss of contact between the die and the workpiece. Each of the lengths of the leading teeth section 13 and the finishing teeth section 14 is made to have that of at least more than one revolution(s) of the cylindrical workpiece.

Usually, in the tooth rolling flat dies 11(12) shown in the FIG. 3, the former substantially half portion 13*a* of the leading teeth section 13 is applied thereon a sandblasting treatment to prevent a slip between the die and the workpiece. Since in each of the latter half portion 13*b* of the leading teeth section 13, the finishing teeth section 14 and the roll-off teeth section 15, the teeth of each die and the workpiece mesh with each other closely, no slip occurs therebetween. Therefore, no sandblasting treatment is applied in these sections. From the point of view of machining accuracy of the machined surface, it is essentially important that no slip between the die and the workpiece occurs. Therefore, it is common practice to apply the sandblasting treatment on the former substantially half portion 13*a* of the leading teeth section 13 so that a frictional force is generated between it and workpiece, thereby prevents the slippage when the die penetrates the cylindrical workpiece. For this aim, the surface roughness Rz of maximum height of the former substantially half portion 13*a* of the leading teeth section 13 is made to range 20 to 35 $\mu$m to permit so that no slippage occurs when oil coolant is applied on the workpiece.

Heretofore, rolling teeth for forming teeth, such as spline teeth and gear teeth on the periphery of cylindrical workpieces are generally conducted by pouring oil coolant on the workpiece. However, from the points of view of the protection of environment, for clean machining and for saving oil coolant cost, tooth rolling flat dies and a method for forming the teeth without using oil coolant, that is forming the teeth by semi-dry forming in which a very small amount of oil mist is sprayed on the cylindrical workpiece to be rolled, is desired. To date, however, semi-dry forming using conventional tooth rolling flat dies resulted that the lives of the dies are shortened compared with those of the dies using oil coolant thereby increased the machining cost.

SUMMARY OF THE INVENTION

Accordingly, it is a general object of the present invention to provide tooth rolling flat dies and a method for forming the teeth, such as spline teeth and gear teeth on the periphery of cylindrical workpieces, which overcome the disadvantages of the prior art and which have the same service lives as those of the conventional tooth rolling flat dies using oil coolant even if a semi-dry forming the teeth in which a very small amount of oil mist is sprayed on the workpieces to be rolled is conducted, thereby enabled to provide an environment-protective tooth rolling flat dies for semi-dry forming the teeth.

According to one aspect of the present invention, these and other object of the present invention are achieved by providing a tooth rolling flat die for forming a tooth including a spline tooth and a gear tooth on a periphery of a cylindrical workpiece. Each die having one working surface thereon teeth sections comprising in series a leading teeth section wherein heights of the tops of the teeth are gradually increasing from a front edge to a rear edge of the die until full height thereof is reached, a finishing teeth section each of the teeth having the full height and a roll-off teeth section in which heights of the teeth are rapidly decreasing. Wherein the first substantially quarter length portion of the leading teeth section has a first surface roughness Rz of maximum height of ranging 20 to 35 $\mu$m, and the second substantially quarter length portion of the leading teeth section has a second surface roughness Rz of maximum height of ranging 5 to 20 $\mu$m.

From the applicants' study, they discovered that a typical pattern to end the service lives of many conventional tooth rolling flat dies is followingly, that is, at first, a chipping off from the edge of the coast side (the finishing teeth section side as seen from the leading teeth section) of a tooth crest of the second substantially quarter length portion of the leading teeth section occurs, then, the pressure load on the teeth of the finishing teeth section increases, resulting that the teeth thereof are destroyed and ends the final service life of the die. Also, applicants discovered that the reason that the chipping occurs firstly at the edge of the teeth of the second substantially quarter length portion on which the sandblasting treatment is applied lies in that, since the surface roughness of the teeth is coarse or rough, a stress concentration is liable to cause thereon. Further, a large frictional force is generated on the teeth which results the corresponding increase in the stress applied thereon. Additionally, applicants further observed that the slippage decreases in the former substantially half portion of the leading teeth section when the semi-dry forming is conducted.

As stated earlier, the surface roughness Rz of maximum height of the teeth of the former substantially half portion 13*a* of the leading teeth section 13 of the conventional tooth rolling flat die 11,(12) is made to range 20 to 35 $\mu$m by applying a sandblasting thereon. However, according to the present invention, since the surface roughness Rz of maximum height of the teeth of the second substantially quarter length portion of the leading teeth section is made smaller to range 5 to 20 $\mu$m, the stress concentration thereon is decreased which results the corresponding decrease in the stress thereon. This prevents the occurrence of the chipping off from the teeth of second substantially quarter length portion of the leading teeth section in which such a chipping off is liable to occur in the conventional tooth rolling flat die. Further, although the surface roughness Rz of maximum height of the teeth of the substantially quarter length portion is made smaller, in case the semi-dry forming is conducted, no slippage between the die and the workpiece occurs.

Since no slippage between the die and the workpiece occurs and the occurrence of the chipping off from the teeth of second substantially quarter length portion of the leading teeth section is very few, the tooth rolling flat dies for forming teeth according to the present invention enabled to have the same service lives and machining accuracy of the machined surface as those of the conventional tooth rolling flat dies using oil coolant even if the semi-dry forming the teeth is conducted, thereby it enabled to provide environment-protective tooth rolling flat dies for semi-dry forming the teeth. The surface roughness Rz of maximum height of the teeth is easily adjusted by selecting appropriate size of abrasive grits used in sandblasting treatment, and these adjustment is simple and easy to process.

According to another aspect of the present invention, the above and other object of the present invention are also achieved by providing a tooth rolling flat die for forming a tooth including a spline tooth and a gear tooth on a periphery of a cylindrical workpiece having one working surface thereon teeth sections comprising in series a leading teeth section wherein heights of the tops of the teeth are gradually increasing from a front edge to a rear edge of the die until full height thereof is reached, a finishing teeth section each of the teeth having the full height and a roll-off teeth section in which heights of the teeth are rapidly decreasing. Wherein the first substantially quarter length portion of the leading teeth section has a first surface treated thereon a first sandblasting treatment, and the second substantially quarter length portion of the leading teeth section has a second surface treated thereon a second sandblasting treatment, so that the surface roughness Rz of maximum height of the teeth of the first substantially quarter length portion of the leading teeth section is made larger than that Rz of maximum height of the teeth of the second quarter length portion.

Preferably, the surface roughness Rz of maximum height of the teeth of the first substantially quarter length portion ranges 20 to 35 $\mu$m, whereas that Rz of maximum height of the teeth of the second substantially quarter length portion ranges 5 to 20 $\mu$m.

More preferably, high hardness of the surfaces of teeth of the tooth rolling flat dies is preferred, to achieve this, an ion-nitriding process in which in a vacuum chamber the dies are connected to a negative pole and the wall of the vacuum chamber is connected to a positive pole, wherein a nitrogen gas and a hydrogen gas are introduced therein to be effected a glow discharge, thereby a nitriding is coated on the surfaces of dies. A shot peening process or both ion-nitriding and the shot peening process may be applied on the whole or partial surfaces of the die. Applying the ion-nitriding process first before the shot peening process is preferred, however, the ion-nitriding process may be followed to the shot peening process. The tooth rolling flat dies thus both processed are adapted for forming the teeth by semi-dry forming in which a very small amount of oil mist is sprayed on the workpiece to be rolled. By applying such ion-nitriding and/or shot peening process on the die, a tooth rolling flat die and a method for forming the teeth which are adapted for forming the teeth by semi-dry forming having a longer service life are provided.

DETAILED DESCRIPTION OF THE PREFERRED EMBODIMENTS

Figure 1:
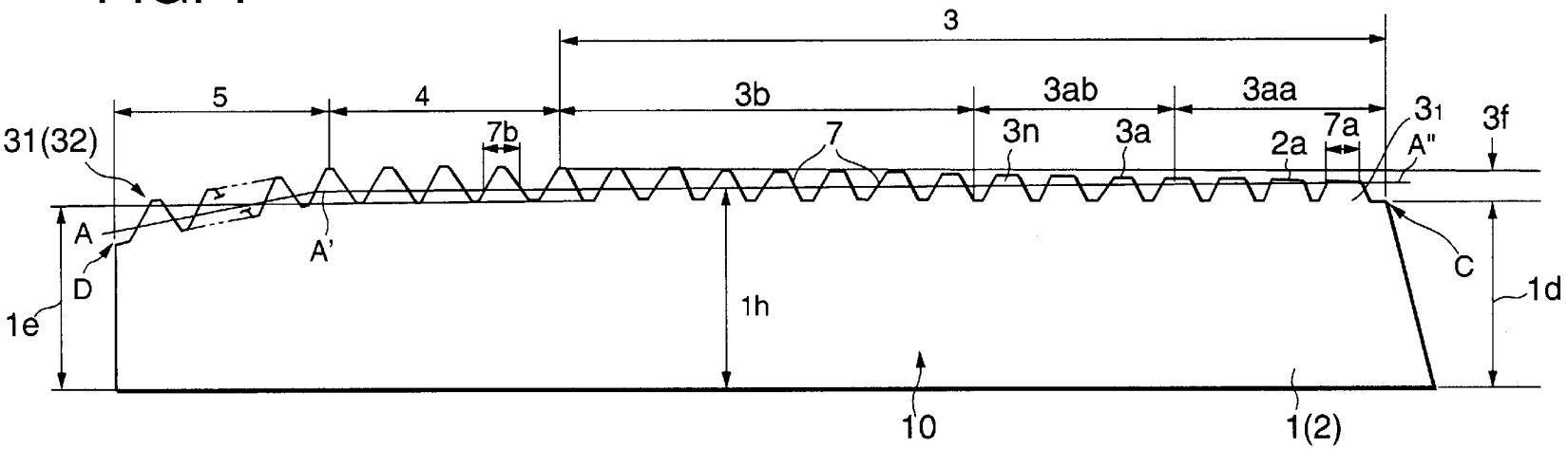
FIG. 1 is a schematic longitudinal view showing the side configuration of a tooth rolling flat die according to the present invention.
Figure 2:
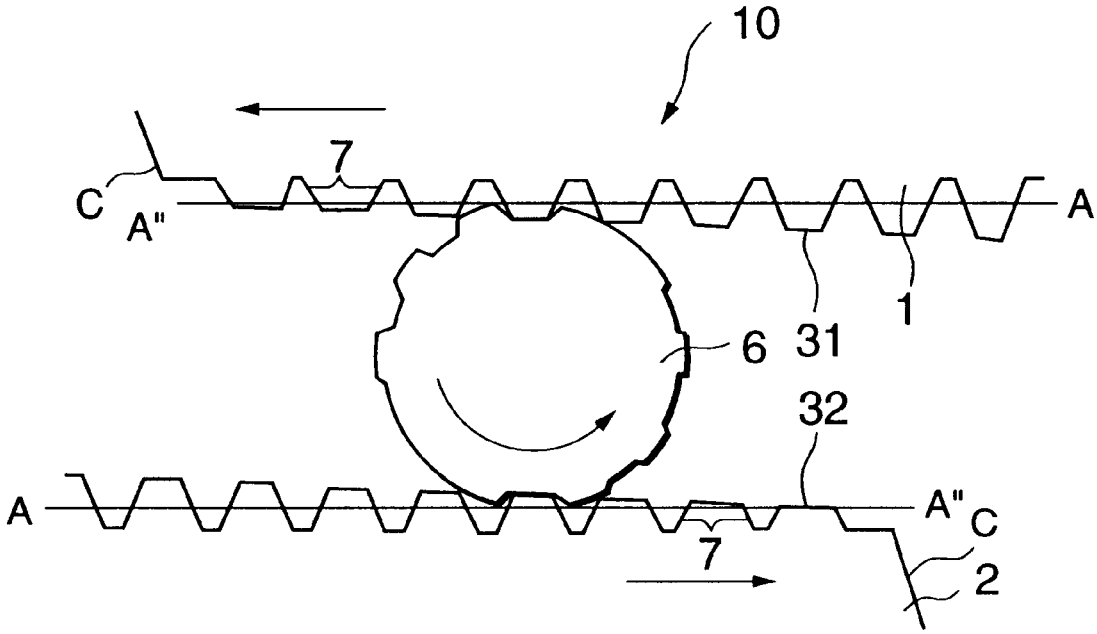
FIG. 2 is a schematic representation showing a pair of tooth rolling flat dies according to the present invention rolling a spline or tooth formation.

Referring to FIGS. 1 and 2, a preferred embodiment of the invention comprises a specific tooth construction for a set of rack type tooth rolling flat dies, which set is generally designated 10, and which set is comprised of a pair of tooth rolling flat dies, generally designated 1 and 2, which dies may be utilized in identical sets to pressure form spline teeth and gear teeth on the periphery of cylindrical workpieces. Each die face 31, (32)of the tooth rolling flat dies 1, (2) is provided thereon in series a leading teeth section 3 wherein height 3*f* of the tops of the teeth 7 are gradually increasing from the front edge C to the rear edge D of the die 1, (2) until full height 3*f* thereof is reached to permit the die 1, (2) to penetrate the cylindrical workpiece 6 until full depth is reached, a finishing teeth section 4 in which each of the teeth 7 having full height 3*f* and a roll-off teeth section 5 in which height 3*f* of the tops of the teeth 7 are rapidly decreasing to permit gradual loss of contact between the die and the workpiece.

Each length of the leading teeth section 3 and the finishing teeth section 4 is made to have that of at least more than one revolution(s) of the cylindrical workpiece 6, respectively. Each length of the first and second substantially quarter length portion 3*aa*, 3*ab* of the leading teeth section 3 is made to have that of one revolution of the cylindrical workpiece 6. Therefore, former substantially half length portion 3 of the leading teeth section 3 is made to have that of two revolutions of the cylindrical workpiece 6. Wherein the surface roughness Rz of maximum height of the surfaces 2*a* of teeth of the first substantially quarter length portion 3*aa* of the leading teeth section 3 is made to range 20 to 35 $\mu$m by applying sandblasting treatment selecting coarse size of abrasive grits, and that Rz of maximum height of the surfaces 3*a* of teeth of the second substantially quarter length portion 3*ab* of the leading teeth section 3 is made to range 5 to 20 $\mu$m by applying sandblasting treatment selecting fine size of abrasive grits. Reference numeral A–A' shows a pitch line, and reference numerals 1*d*, 1*e* denote the heights of the tooth roots of the teeth and reference numerals 7*a*, 7*b* denote the widths of the teeth on the pitch line A–A' of the leading teeth section 3 and the finishing teeth section 4, respectively, and in this embodiment, 1*d* is made to be equal to 1*e*, however, as the Japanese examined utility model publication Hei 6(1994)-200 discloses in its FIG. 1, the heights 1*d* of the tooth roots and/or the widths 7*a*, 7*b* of the teeth of the teeth of the former substantially half portion of the leading teeth section 3 may be made to increase toward to the rest half portion, respectively.

In operation, as partially shown in FIG. 2, tooth rolling flat dies 1, 2 are used in mating pair with their toothed faces 31, 32 facing each other. The cylindrical workpiece 6 of the splines and teeth to be rolled is placed between the dies 1, 2 at one end thereof. The dies are then pressed against the cylindrical workpiece and the dies 1, 2 is moved longitudinally, thereby rotating the workpiece 6 about its axis and roll forming the splines and teeth thereon while the workpiece 6 is at ambient or room temperature and without removal of material from the workpiece 6.

EXAMPLE 1

Figure 3:
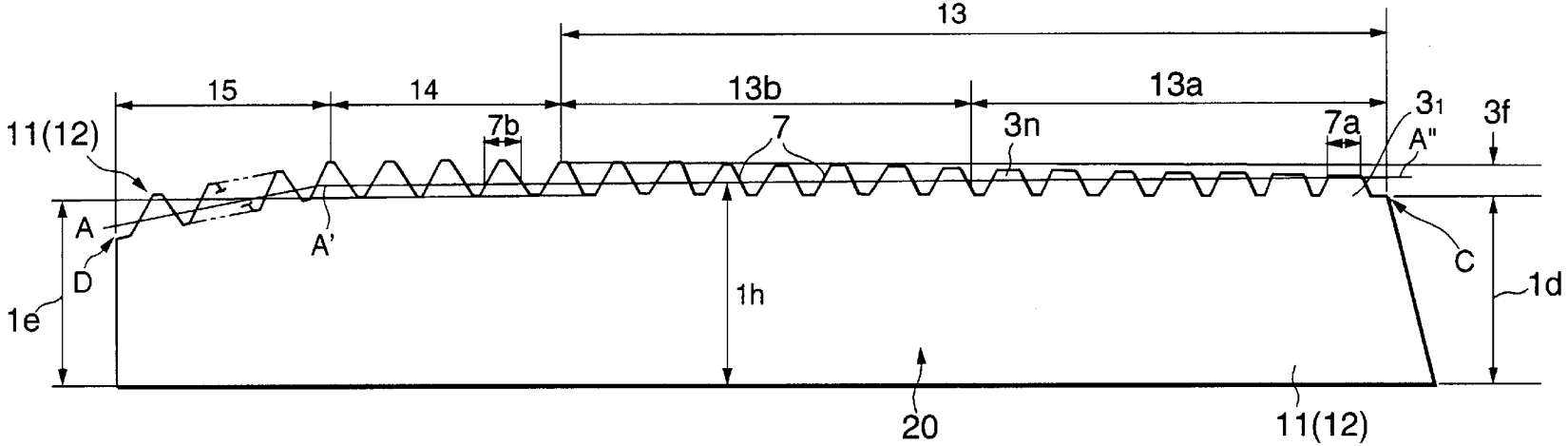
FIG. 3 PRIOR ART
FIG. 3 is a partial schematic longitudinal view showing the side configuration of a conventional tooth rolling flat die.

Involute splines are formed on the periphery of cylindrical workpieces using a pair of tooth rolling flat dies shown in FIGS. 1 and 2 by semi-dry forming in which a very small amount of oil mist is sprayed on the workpieces to be rolled. The dimensions of the involute splines are; module: 1.058 pressure angle: 30° and face width of the spline: 20 mm. The results showed that the same or more longer service life as that of using a pair of conventional tooth rolling flat dies shown in FIG. 3 conducted by the wet forming is achieved even if the forming is conducted using the tooth rolling flat dies shown in FIGS. 1 and 2 by the semi-dry forming. This means that according to the tooth rolling flat dies, since the surface roughness Rz of maximum height of the teeth of the second substantially quarter length portion of the leading teeth section is made smaller, the stress concentration thereon is decreased, thereby the damage on the teeth of the substantially quarter length portion area is deterred. Further, the surface roughness Rz of the teeth of the substantially quarter length portion being fine, in case the semi-dry forming is conducted, even if the lubrication of the dies and the workpiece is insufficient, no slippage between the die and the workpiece occurs. And machining accuracy of the machined surface is kept equal compared with that of the machined surfaces using the conventional tooth rolling flat dies and conducted by the wet forming.

The pair of tooth rolling flat dies for forming involute splines shown in FIGS. 1 and 2 are subjected to an ion-nitriding process in which in a vacuum chamber dies are connected to a negative pole, and the wall of the vacuum chamber is connected to a positive pole all not shown, wherein a nitrogen gas and a hydrogen gas are introduced therein to effect a glow discharge, thereby a nitriding is coated on the surfaces of the teeth of the dies. Then ion-nitrided surfaces of the teeth of the second substantially quarter length portion 3*ab* of the leading teeth section 3, the substantially latter half portion 3*b* of the leading teeth section 3, the finishing teeth section 4 and the roll-off teeth section 5 of the dies 1, 2 are subjected to a shot peeing process. The tooth rolling flat dies thus treated enabled to have longer service life over 1.5 times longer compared with that of using the conventional tooth rolling flat dies and conducted by the wet forming. Further, the machining accuracy of the machined surface is kept equal compared with that of the machined surface using the conventional tooth rolling flat dies and conducted by the wet forming.

While a preferred embodiment of the invention has been illustrated and described with reference to the tooth rolling flat dies for forming teeth by semi-dry forming in which a very small amount of oil mist is sprayed on the workpieces to be rolled, however, the tooth rolling flat dies according to this invention can achieve the same longer service lives:in cases wherein the forming teeth is conducted using oil coolant or by complete dry forming.

What is claimed is:

1. A tooth rolling flat die for forming a tooth, of the type including a spline tooth and a gear tooth, on a periphery of a cylindrical workpiece, said die having teeth sections on one working surface thereof, with the teeth sections comprising, in series, a leading teeth section wherein heights of the tops of the teeth are gradually increasing from a front edge to a rear edge of the die until a full height thereof is reached, a finishing teeth section in which each of the teeth has the full height, and a roll-off teeth section in which heights of the teeth are rapidly decreasing;

wherein a first substantially quarter length portion of the leading teeth section has a first surface roughness Rz of maximum height ranging from 20 to 35 $\mu$m, and a second substantially quarter length portion of the leading teeth section has a second surface roughness Rz of maximum height ranging from 5 to 20 $\mu$m, so that roughness heights differ between the first and second quarter length portions.

2. A tooth rolling flat die for forming a tooth, of the type including a spline tooth and a gear tooth, on a periphery of a cylindrical workpiece, said die having teeth sections on one working surface thereof, with the teeth sections comprising, in series, a leading teeth section wherein heights of the tops of the teeth are gradually increasing from a front edge to a rear edge of the die until a full height thereof is reached, a finishing teeth section in which each of the teeth has the full height, and a roll-off teeth section in which heights of the teeth are rapidly decreasing;

wherein a first substantially quarter length portion of the leading teeth section has a first surface treated by a first sandblasting treatment, and a second substantially quarter length portion of the leading teeth section has a second surface treated by a second sandblasting treatment, so that the surface roughness Rz of maximum height of the teeth of the first substantially quarter length portion of the leading teeth section is larger than the surface roughness Rz of maximum height of the teeth of the second quarter length portion.

3. The tooth rolling flat die claimed in claim 2 wherein the surface roughness Rz of maximum height of the teeth of the first substantially quarter length portion ranges from 20 to 35 $\mu$m, whereas that Rz of maximum height of the teeth of the second substantially quarter length portion ranges from 5 to 20 $\mu$m.

4. The tooth rolling flat die claimed in claim 2 wherein the whole or partial surface of the die has an ion-nitriding treated surface thereon.

5. The tooth rolling flat die claimed in claim 3 wherein the whole or partial surface of the die has a shot peening treated surface thereon.

6. The tooth rolling flat die claimed in claim 3 wherein the whole or partial surface of the die has a surface with both an ion-nitriding and a shot peening treated thereon.

7. A method for forming a tooth, of the type including a spline tooth and a gear tooth, on a periphery of a cylindrical workpiece comprising the steps of:

providing a tooth rolling flat die having teeth sections on one working surface thereof, with the teeth sections comprising, in series, a leading teeth section wherein heights of the tops of the teeth are gradually increasing from a front edge to a rear edge of the die until a full height thereof is reached, a finishing teeth section in which each of the teeth has the full height, and a roll-off teeth section in which heights of the teeth are rapidly decreasing, wherein a first substantially quarter length portion of the leading teeth section has a first surface roughness Rz of maximum height ranging from 20 to 35 $\mu$m, and a second substantially quarter length portion of the leading teeth section has a second surface roughness Rz of maximum height of ranging from 5 to 20 $\mu$m, so that roughness heights differ between the first and second quarter portion; and forming the tooth by semi-dry forming including:

spraying a very small amount of oil mist on the workpiece; and rolling the workpiece using the tooth rolling flat die.

8. The method for forming the teeth by semi-dry forming claimed in claim 7, wherein the whole or partial surface of the die has an ion-nitriding treated surface thereon.

9. The method for forming the teeth by semi-dry forming claimed in claim 7, wherein the whole or partial surface of the die has a shot peening treated surface thereon.

10. The method for forming the teeth by semi-dry forming claimed in claim 7, wherein the whole or partial surface of the die has a surface with both an ion-nitriding and a shot peening treated thereon.

* * * * *